United States Patent [19]

Fido

[11] 4,288,848

[45] Sep. 8, 1981

[54] CLAMP MOUNTED AND PORTABLE EXTENSION LAMP

[76] Inventor: Stefon Fido, 5 Primrose St., Indian Orchard, Mass. 01151

[21] Appl. No.: 104,361

[22] Filed: Dec. 17, 1979

[51] Int. Cl.[3] ..... F21V 15/00

[52] U.S. Cl. ..... 362/378; 362/396; 362/398; 362/419; 362/430

[58] Field of Search ..... 362/378, 396, 398, 419, 362/430

[56] References Cited

U.S. PATENT DOCUMENTS

| | | | |
|---|---|---|---|
| 3,596,084 | 7/1971 | Henning et al. | 362/396 |
| 3,851,166 | 11/1974 | Kohler | 362/396 |
| 3,917,940 | 11/1975 | Duddy | 362/398 |
| 3,992,618 | 11/1976 | Matthews et al. | 362/396 |

*Primary Examiner*—Stephen J. Lechert, Jr.
*Attorney, Agent, or Firm*—Ross, Ross & Flavin

[57] ABSTRACT

A lamp having an elongated flexible support of a length to allow extension of the lamp in a plurality of directions with a lamp socket and hangable protector at its outboard extremity and a C clamp at its inboard extremity for holding the lamp in a selected position of adjustment.

1 Claim, 1 Drawing Figure

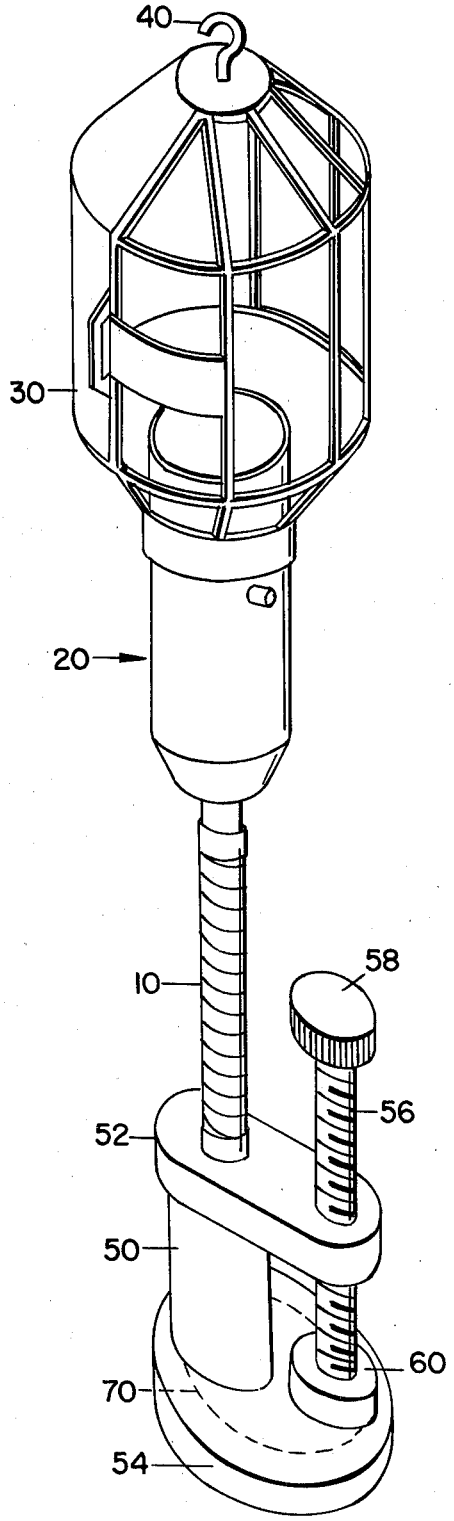
40
30
20
10
58
56
52
50
60
70
54

CLAMP MOUNTED AND PORTABLE EXTENSION LAMP

The invention relates to a clamp mounted and portable extension lamp which may be adjustably mounted on a bench, table, machine or the like or may be suspended from a pin, post, rod, cable, machine or the like or may be supported against a suitable metallic surface by a permanent magnet.

BACKGROUND OF THE INVENTION

1. Field of the Invention

The invention relates to a clamp mounted and portable lamp which may be effectively clamped to a bench or the like and may be shifted into a plurality of positions with respect to its support by the means of an elongated flexible support, while at the same time it incorporates a protector covering the lamp in a protective manner, which protector may also be suspended from an overhead means such as a pin or post or hook when the lamp is not clamped to its supporting bench so as to lend portability to the lamp.

2. Description of the Prior Art

Lamps provided with a clamp for mounting have been known, as for example, U.S. Pat. No. 2,358,422 of Sept. 19, 1944 to E. J. Springer, but have suffered from the disadvantage that they have offered a small or short support so as to preclude the shifting of the lamp means through a wide range of positions.

SUMMARY OF THE INVENTION

The primary purpose of the invention is to teach an elongated flexible support having such a length as to allow the shifting of the lamp means in a great plurality of positions throughout a circle of 360 degrees, and in combination therewith a clamp mechanism by which the lamp may be secured to the edge of a bench, or table or other work area, as well as a protective device in the form of a bulb shield, which device will be topped by a hook means to facilitate the suspending of the lamp from a pin or hook or the like.

Another object is to provide a device which is relatively inexpensive in its manufacture and simple in its operation and is durable in construction.

One key object of the invention is to provide a system of the above described character which will allow a lamp to be alternatively mounted on a bench or table or machine or whatever and suspended downwardly from a rod or cable or pin or hook or machine part.

Yet another object of the invention is to provide a lamp with a novel magnetized clamping bracket for clamping the lamp to another structure or to hold it thereto by magnetic attraction.

Other objects will be pointed out in the following description.

BRIEF DESCRIPTION OF THE DRAWING

The drawing illustrates, in isometric view, a lamp in accordance with the invention.

DESCRIPTION OF THE PREFERRED EMBODIMENTS

The lamp comprises an elongated flexible support member 10 called a neck which will normally extend in a generally vertical direction but may be flexed in all directions throughout a 360 degree circle.

The upper extremity of the neck is connected mechanically and electrically to a socket housing 20, at the upper end of which an electric bulb, not shown, may be threadedly engageable in the usual and known manner.

The socket housing will be provided with the usual attached cord of sufficient length so as to give to the lamp the character of being positionable in any desired area within a room.

A bulb shield 30 is fitted to the socket housing.

At the topmost extremity of the bulb shield 30 a hook 40 is provided.

At the opposite extremity of the neck a base is provided in the form of a C clamp which includes a base bar 50 to which the neck is secured, the neck and base bar extending coaxially as to each other, and an upper leg 52 and a lower leg 54 extendable outwardly from and in spaced parallel planes normal to the axis of the base bar, the legs being welded or otherwise secured to the base bar.

A screw 56 is threadedly receivable through the upper leg 52 and is provided with a manually engageable knob 58 at its upper end and a clamp 60 at its lower end.

The lamp is adapted to be clamped as by means of the clamping member to a bench or table or the like.

A wire, not shown, is extendable through the neck 10 to the socket housing 20 for supplying current to the lamp in the known manner.

The arrangement makes it possible to clamp the lamp to a table or bench or the like between the clamp plug and the lower leg and when so clamped, the neck may be extended vertically upwardly as shown in the drawing or may be rotated throughout a 360 degree circle.

The clamp allows the lamp to be positioned in any desired location with respect to the front or rear or side edges of the bench or table.

Conceivably the lamp could be clamped to a door or door frame or other vertically disposed or horizontally disposed surface.

While the preferred embodiment of the invention has been illustrated and described, it will be understood by those skilled in the art that changes and modifications may be made without department from the letter and spirit of the invention.

A magnet 70 is disposed within a suitably provided recess on member 54 for magnetic adherence in any position of placement upon a ferro-magnetic surface and without the use of the clamping feature.

When the lamp is magnetically adhered to a ferromagnetic surface, the magnet will provide a high density, light weight magnetic holding force of uniform area so as to provide a more secure magnetic adhering means than through the use of a magnet having a smaller contact surface.

It will be advantageous to cementitiously attach the magnet to the member 54 and it will be further advantageous to form the member 54 of a magnetic metallic material so that the inherent magnetic force of the magnet will augment the adhesive bond of the cementitious material by which the magnet is attached to member 54.

I claim:

1. A lamp comprising in combination:

a flexible neck having an upper outboard extremity and a lower inboard extremity, the neck normally extending in a generally vertical direction, but adapted to be flexed in all directions throughout a 360 degree circle, a socket housing mounted on the upper outboard extremity of the neck and having a bulb receiving socket, a bulb threadedly receivable in the socket, a bulb shield fitted to the socket housing, a hook on the topmost extremity of the bulb shield whereby the lamp may be suspended from a support such as a pin or post or hook, means for supplying an electric current to the socket, a base associated with the lower inboard extremity of the neck in the form of a C clamp including a base bar to which the neck is secured, the neck and base bar extending coaxially as to each other, an upper leg and a lower leg extendable outwardly from and in spaced parallel planes normal to the axis of the base bar, a screw threadedly receivable through the upper leg, a manually engageable knob at the upper end of the screw and a clamp at the lower end of the screw for bringing the C clamp into tight damping relationship with a vertically or horizontally disposed surface, and a permanent magnet connected fixedly to a surface of the lower leg of the C clamp for providing an effective area of magnetic force on the clamp to support same against tilting and accidental removal of the lamp from a steel or ironcontaining supporting surface when attached thereto.

* * * * *

UNITED STATES PATENT OFFICE

CERTIFICATE OF CORRECTION

PATENT NO. : 4,288,848

DATED : September 8, 1981

INVENTOR(S) : Stafan Fido

It is certified that error appears in the above-identified patent and that said Letters Patent are hereby corrected as shown below:

On title page, at item [76] change "Stefon" to "Stafan"

Signed and Sealed this

*Twenty-fourth* Day of *November 1981*

[SEAL]

*Attest:*

GERALD J. MOSSINGHOFF

*Attesting Officer*

*Commissioner of Patents and Trademarks*